US005924888A

United States Patent [19]

Larkin

[11] Patent Number: 5,924,888

[45] **Date of Patent: *Jul. 20, 1999**

[54] ELECTRICAL PLUG

[75] Inventor: Brian S. Larkin, Moss Beach, Calif.

[73] Assignee: Raychem Corporation, Menlo Park, Calif.

[ * ] Notice: This patent is subject to a terminal disclaimer.

[21] Appl. No.: 08/881,335

[22] Filed: Jun. 24, 1997

Related U.S. Application Data

[63] Continuation-in-part of application No. 08/587,433, Jan. 17, 1996, Pat. No. 5,718,600.

[51] Int. Cl.[6] ..... H01R 4/26

[52] U.S. Cl. ..... 439/410; 439/696

[58] Field of Search ..... 439/410, 417, 439/695, 696, 697, 687

[56] References Cited

U.S. PATENT DOCUMENTS

| | | | |
|---|---|---|---|
| 2,769,154 | 10/1956 | Greenbaum | 439/410 |
| 3,620,104 | 11/1971 | Horrocks | 81/9.5 C |
| 3,675,182 | 7/1972 | Gregory | 339/98 |
| 3,858,144 | 12/1974 | Bedard et al. | 338/22 R |
| 3,861,029 | 1/1975 | Smith-Johannsen et al. | 29/611 |
| 4,017,715 | 4/1977 | Whitney et al. | 219/553 |
| 4,242,573 | 12/1980 | Batliwalla | 219/528 |
| 4,334,148 | 6/1982 | Kampe | 219/553 |
| 4,334,351 | 6/1982 | Sopory | 29/611 |
| 4,370,808 | 2/1983 | Maytham | 30/353 |
| 4,409,713 | 10/1983 | Johnston | 29/33 M |
| 4,426,339 | 1/1984 | Kamath et al. | 264/22 |
| 4,459,473 | 7/1984 | Kamath | 219/553 |
| 4,574,188 | 3/1986 | Midgley et al. | 219/549 |
| 5,002,501 | 3/1991 | Tucker | 439/417 |
| 5,004,432 | 4/1991 | Tucker | 439/417 |
| 5,023,995 | 6/1991 | Kaplan | 30/90.1 |
| 5,111,032 | 5/1992 | Batliwalla et al. | 219/549 |
| 5,190,469 | 3/1993 | Mui | 439/410 |
| 5,252,081 | 10/1993 | Hart | 439/98 |
| 5,514,006 | 5/1996 | Getselis et al. | 439/417 |
| 5,673,486 | 10/1997 | Brown | 30/90.1 |

FOREIGN PATENT DOCUMENTS

| | | | |
|---|---|---|---|
| 456713 | 7/1968 | Switzerland | H01R 7/22 |
| WO 91/05377 | 4/1991 | WIPO | H01R 4/24 |
| WO 91/17642 | 11/1991 | WIPO | H05B 3/00 |
| WO 96/35242 | 11/1996 | WIPO | H01R 4/50 |

*Primary Examiner*—Steven L. Stephan
*Assistant Examiner*—Brian J. Biggi
*Attorney, Agent, or Firm*—Marguerite E. Gerstner; Herbert G. Burkard

[57] ABSTRACT

An electrical plug for connecting an electrical cable such as an electrical heating cable to an electrical power outlet. Contained within the housing of the plug are first and second contact members which comprise a first prong and a second prong, respectively, each prong being suitable for insertion into a socket of an electrical power outlet. A cutting module and a cutting element which fits within the cutting module are used to remove polymer, e.g. insulation or a conductive polymer composition, from the first and second electrodes of the cable at the end of the cable in order to make electrical connection from the electrodes to the first and second contact members. Present within the cutting module are first and second electrode-contact sections positioned on the concave arcuate inner surface of the wall of a cavity in the cutting module. The electrode-contact sections can be electrically connected to the first and second contact members. The cutting element comprises a cutting wedge which has (a) a convex arcuate outer surface which complements the inner surface of the wall of the cutting module, and (b) piercing means suitable for penetrating the polymer. The cutting element rotates within the cavity of the cutting module from an opened position to a closed position so that, after the cable has been inserted into the cavity and the cutting element is rotated, the rotation first causes the piercing means to penetrate the polymer between the first and second electrodes, then causes an end portion of the polymer to separate from the electrodes, and then forces the first electrode into physical contact with the first electrode-contact section and the second electrode into physical contact with the second electrode-contact section. The cutting module and the cutting element can also be used as a tool for removing polymer from an electrical cable, and in a connector to make electrical connection from a first electrical cable to a second electrical cable.

14 Claims, 5 Drawing Sheets

ELECTRICAL PLUG

CROSS-REFERENCE TO RELATED APPLICATIONS

This application is a continuation-in-part application of commonly assigned application Ser. No. 08/587,433, filed Jan. 17, 1996, now U.S. Pat. No. 5,718,600, issued Feb. 17, 1998, the disclosure of which is incorporated herein by reference.

BACKGROUND OF THE INVENTION

1. Field of the Invention

This invention relates to electrical plugs, particularly electrical plugs which are useful for making an electrical connection between an elongate electrical cable and an electrical power outlet.

2. Introduction to the Invention

It is often necessary to make an electrical connection from an elongate cable such as a power cord, a grounded power lead, or heating cable to another elongate cable or to a source of electrical power such as a wall outlet. Connection to a power source is frequently made by means of an electrical plug. Connection of the cable to the plug often requires tedious and craft-sensitive assembly, as well as the use of special tools, in order to ensure that good electrical connection is achieved.

Elongate heating cables are one type of cable which often requires connection to a plug. Such heating cables are known for use in the freeze protection and temperature maintenance of pipes. Particularly useful elongate heating cables comprise (a) first and second elongate electrodes, (b) a plurality of resistive heating elements connected in parallel between said electrodes, e.g. a continuous strip of a conductive polymer in which the electrodes are embedded or which is wrapped around the electrodes, and (c) an insulating jacket which surrounds the electrodes and heating elements. In addition, the heating cable often also comprises a metallic grounding layer, in the form of a braid or a tape, surrounding the insulating jacket, which serves to electrically ground the heating cable and provides abrasion resistance. The heating cable may be cut to the appropriate length for use in each application, and connection must then be made to the plug.

Conventional electrical plugs for use with heating cables often require that, prior to installation of the cable into the plug, the conductive polymer must be stripped from the electrodes. Such an electrical plug is disclosed in U.S. Pat. Nos. 5,002,501 (Tucker) and 5,004,432 (Tucker), the disclosure of which is incorporated herein by reference. Stripping the polymer can be difficult, may require special tools, and may not result in completely "clean" electrodes, thus making good electrical connection to the plug difficult. In addition, the time required to strip the polymer and assemble the plug is relatively high. U.S. Pat. No. 5,252,081 (Hart) discloses a plug in which the electrode need not be stripped prior to insertion of the cable into the plug. Connection to the electrodes is made with conductive piercing means which penetrate the insulating jacket and the conductive polymer, thus contacting the electrodes. In order to make adequate contact, it is necessary that the piercing means, e.g. screws, be sufficiently tightened. In addition, it is important that the dimensional tolerance be precise to ensure that the screws directly contact the electrodes and maintain good electrical connection even after creep and/or aging of the polymer and electrodes.

SUMMARY OF THE INVENTION

We have now found that it is possible to make an easy, reliable connection to an electrical cable without stripping the polymeric insulation from the electrodes and without the need for using screws or other means of penetrating the insulation to precisely contact the electrodes. By the use of our invention it is possible to insert an electrical cable into the plug, rotate a cutting element, e.g. 90°, to remove the surrounding polymer and ensure contact of the electrodes with the electrical contacts, and lock the cable into position to provide adequate strain relief. No special tools are required. Thus, in a first aspect this invention provides an electrical plug for connecting an electrical cable to an electrical power outlet, said electrical cable comprising a first elongate electrode and a second elongate electrode, said first and second electrodes surrounded by and separated from one another by a polymer, said plug comprising (A) a housing which comprises
  (1) a first housing member which comprises a slot for receiving the cable, and
  (2) a second housing member, the first and second housing members being movable relative to each other between a unique mated configuration and a demated configuration;

(B) a first contact member which comprises a first prong suitable for insertion into one socket of an electrical power outlet;

(C) a second contact member which comprises a second prong suitable for insertion into a second socket of an electrical power outlet;

(D) a cutting module which is positioned in the first housing member and which comprises
  (1) a cavity comprising a wall which has a concave arcuate inner surface,
  (2) an opening in the wall which opens into the cavity and is aligned with the slot for receiving the cable,
  (3) a first electrode-contact section which is positioned on the inner surface of the wall and can be electrically connected to the first prong, and
  (4) a second electrode-contact section which is positioned on the inner surface of the wall and can be electrically connected to the second prong; and (E) a cutting element which
  (1) fits within the cutting module,
  (2) comprises a cutting wedge which comprises
    (a) a convex arcuate outer surface which complements the inner surface of the wall, and
    (b) piercing means suitable for penetrating the polymer, and
  (3) rotates within the cavity from an opened position to a closed position so that, after the cable has been inserted into the cavity through the opening and the cutting element is rotated, the rotation
    (a) first, causes the piercing means to penetrate the polymer between the first and second electrodes,
    (b) second, causes an end portion of the polymer to separate from the electrodes, and
    (c) third, forces the first electrode into physical contact with the first electrode-contact section and the second electrode into physical contact with the second electrode-contact section.

We have also discovered that particular components that are part of the electrical plug described in the first aspect of the invention are themselves useful, either as part of a connector or other device or by themselves. For example, we have found that a cutting module and a cutting element can be used as a tool for stripping insulation, e.g. polymer, from an electrical cable, including an insulated wire. Thus in a second aspect, this invention provides a tool for removing polymer from an electrical cable comprising a first elongate electrode surrounded by polymer, said tool comprising (A) a cutting module which comprises
  (1) a cavity comprising a wall which has a concave arcuate inner surface, and
  (2) an opening in the wall which opens into the cavity for receiving the cable; and (B) a cutting element which
  (1) fits within the cutting module,
  (2) comprises a cutting wedge which comprises
    (a) a convex arcuate outer surface which complements the inner surface of the wall, and
    (b) piercing means suitable for penetrating the polymer, and
  (3) rotates within the cavity so that, after the cable has been inserted into the opening and the cutting element is rotated, the rotation first causes the piercing means to penetrate the polymer, and then causes an end portion of the polymer to separate from the electrode.

The cutting module and cutting element can also be used in a connector which makes an electrical connection between two or more elongate cables. Thus in a third aspect, the invention provides a connector for connecting an end of a first elongate electrical cable to an end of a second elongate electrical cable, said first cable comprising first and second elongate electrodes surrounded by and separated from one another by a first polymer, and said second cable comprising third and fourth elongate electrodes surrounded by and separated from one another by a second polymer, said connector comprising (A) a housing which comprises
  (1) a first housing member which comprises a first slot for receiving the first cable, and
  (2) a second housing member, the first and second housing members (a) being movable relative to each other between a unique mated configuration and a demated configuration, and (b) when mated comprising an opening for receiving the second cable;

(B) a first connection means for connecting the first electrode to the third electrode within the housing;

(C) a second connection means for connecting the second electrode to the fourth electrode within the housing;

(D) a cutting module which is positioned in the first housing member and which comprises
  (1) a cavity comprising a wall which has a concave arcuate inner surface,
  (2) an opening in the wall which opens into the cavity and is aligned with the first slot for receiving the first cable,
  (3) a first electrode-contact section which is positioned on the inner surface of the wall and can be electrically connected to the first connection means, and
  (4) a second electrode-contact section which is positioned on the inner surface of the wall and can be electrically connected to the second connection means; and (E) a cutting element which
  (1) fits within the cutting module,
  (2) comprises a cutting wedge which comprises
    (a) a convex arcuate outer surface which complements the inner surface of the wall, and
    (b) piercing means suitable for penetrating the first polymer, and
  (3) rotates within the cavity from an opened position to a closed position so that, after the first cable has been inserted into the cavity through the opening and the cutting element is rotated, the rotation
    (a) first, causes the piercing means to penetrate the first polymer between the first and second electrodes,
    (b) second, causes an end portion of the first polymer to separate from the first and second electrodes, and
    (c) third, forces the first electrode into physical contact with the first electrode-contact section and the second electrode into physical contact with the second electrode-contact section.

BRIEF DESCRIPTION OF THE DRAWINGS

The invention is illustrated by the drawings in which.

DETAILED DESCRIPTION OF THE INVENTION

Figure 1:
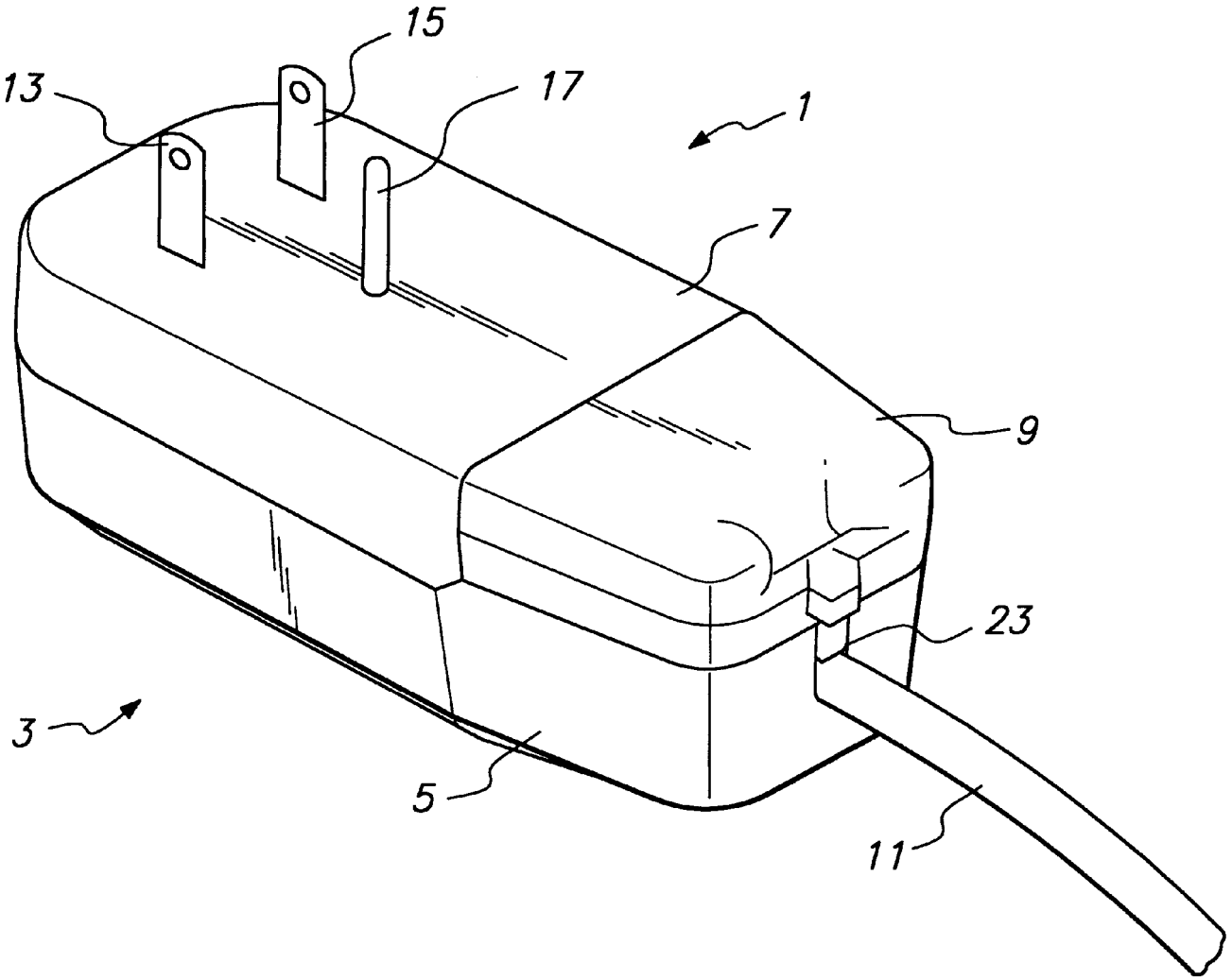
FIG. 1 is a perspective schematic drawing of an electrical plug of the invention.

The electrical plug of the invention is designed to connect an elongate electrical cable to an electrical power outlet, e.g. a wall outlet. The electrical cable may comprise a heating cable, a power cable or cord, a grounded power lead, or other type of cable. Elongate electrical heating cables appropriate for use with this plug are those which comprise first and second elongate electrodes, a plurality of resistive heating elements comprising a polymer connected in parallel between the electrodes, and at least one insulating jacket surrounding the electrodes and heating elements. The insulating jacket is generally polymeric, in the form of a continuous polymer layer, although a polymeric braid or a polymer tape may be used. For some applications a polymeric insulating jacket is surrounded by a second layer, e.g. a second polymeric insulating layer such as a polyester tape, or a metallized tape such as aluminized polyester. The heating cable often comprises an optional metallic grounding braid surrounding the insulating jacket and the optional second layer. The metallic grounding braid serves to electrically ground the heating cable and also provides mechanical strength and abrasion resistance. When a metallic grounding braid is present, it generally is in the form of braided metal wires, although for applications in which flexibility is not critical, it is possible to use another type of metal layer, e.g. a sheath or metal tape. In this specification, the term "metallic grounding braid" is intended to include non-braided metal layers. In some applications, the grounding braid itself is surrounded by an insulating jacket to provide environmental and electrical insulation to the heating cable. Particularly suitable heating cables are self-regulating strip heaters in which the electrodes are elongate wires and the heating elements comprise a conductive polymer composition which exhibits PTC (positive temperature coefficient of resistance) behavior. Heaters of this type are described in U.S. Pat. Nos. 3,858,144 (Bedard et al), 3,861,029 (Smith-Johannsen et al), 4,017,715 (Whitney et al), 4,242,573 (Batliwalla), 4,334,148 (Kampe), 4,334,351 (Sopory), 4,426,339 (Kamath et al), 4,459,473 (Kamath), 4,574,188 (Midgley et al), and 5,111,032 (Batliwalla et al), and International Patent Publication No. WO91/17642 (Raychem Corporation, published Nov. 14, 1991). The disclosure of each of these patents and publications is incorporated herein by reference. The heating cable generally has an approximately rectangular cross-section with two generally parallel faces, although other geometries, e.g. round, oval, or elliptical, can also be used.

In a second aspect, the invention provides a tool for removing polymer from an electrical cable. The cable can be the same type as those used in the electrical plug, although other types of cable, in which there is a single elongate electrode surrounded by polymer, generally an insulating polymer, may be used.

In a third aspect, which provides a connector for making an electrical connection between the ends of first and second elongate electrical cables, the first cable comprises first and second elongate electrodes surrounded by and separated from one another by a first polymer, and the second cable comprises third and fourth elongate electrodes surrounded by and separated from one another by a second polymer. The first and second cables may be the same type as those used in the electrical plug. One or both may also comprise a metallic grounding braid.

The plug comprises a housing which comprises first and second housing members which are capable of existing in a demated or a unique mated configuration. In the demated configuration, the housing members may be separate pieces or they may be connected, e.g. by hinges. When mated, the housing members are in contact with each other, either directly or indirectly through a sealing member such as a gasket. The housing members are maintained in their mated configuration by means of a securing means, e.g. a strap, a latch, a spring clamp, a bracket, one or more screws, or integral snaps. The securing means may be removable in order to allow the housing members to be demated from one another and allow the plug to be reenterable. In a preferred embodiment, the securing means comprises screws which, when tightened after insertion of the cable, ensure that good electrical contact is achieved and maintained.

The first housing member is generally a single piece which may be compartmentalized, either by ribs or bosses, or nominally, for various functions. At one end of the first housing member is a slot for receiving the cable. The slot generally conforms in shape to the cable and has a size slightly larger than the cable (without any metallic ground braid or outer insulating jacket) to make insertion easy. The first housing member should be large enough to accommodate the cutting module and strain relief means (generally both in one compartment), as well as any circuit interrupting device, signal indicator, fuse, or other element (generally all in a second compartment).

The second housing member may be a single piece which may be compartmentalized, but it often comprises two or more sections which are separated from one another. In a preferred embodiment, the second housing member comprises a first section containing the first and second contact members, as well as other electrical components (e.g. circuit interrupting device, signal indicator, fuse), and a second section which comprises a locking bar on an inner surface which can be used to mate with a recess on the cutting element when it is in closed position. The first section often is secured in a permanent fashion to the first housing member before installation of the cable, while the second section can be readily removed and replaced.

Figure 7:
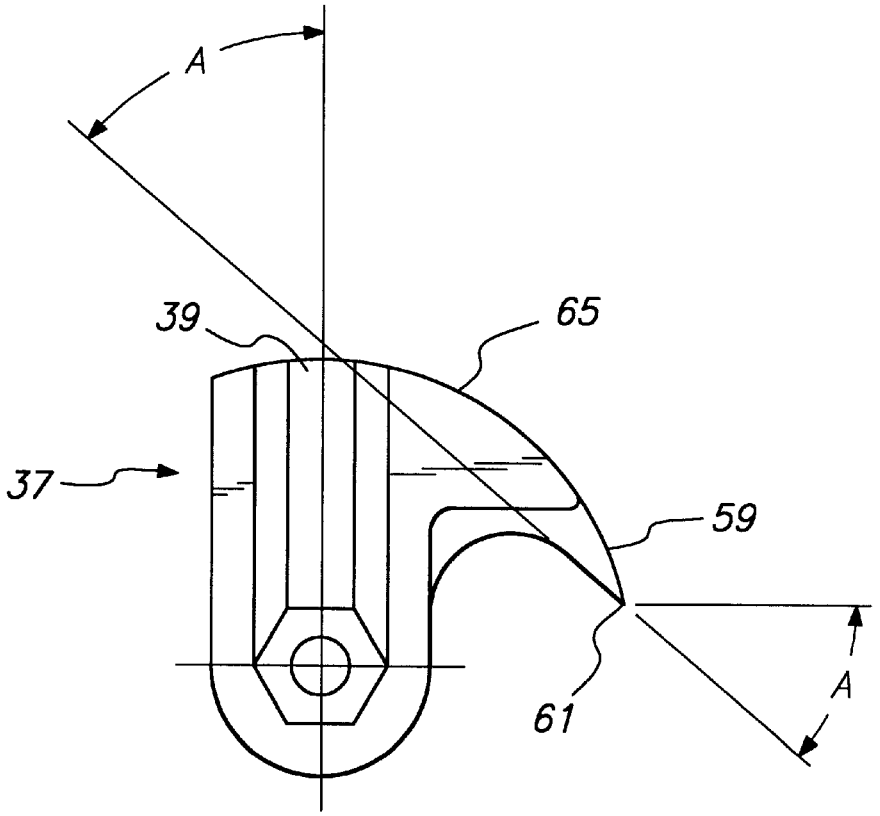
FIG. 7 shows in plan view the cutting element of FIG. 6.

Positioned within the first housing member is a cutting module which comprises a cavity having a wall. In a preferred embodiment, the wall has a concave arcuate inner surface which has an opening which opens into the cavity and is aligned with the slot for receiving the cable. Fitting within the cutting module is a cutting element which comprises a cutting wedge. The cutting wedge preferably comprises a convex arcuate outer surface which complements the inner surface of the wall. Piercing means suitable for penetrating the polymer are part of the cutting wedge, either as an integral part of the cutting wedge or as a separate part. The cutting wedge can rotate within the cavity from an opened position to a closed position, preferably a unique closed position, so that, after the cable has been inserted into the opening and the cutting element is rotated, the rotation first causes the piercing means to penetrate the polymer (between the first and second electrodes), then causes an end portion of the polymer to separate from the electrodes. The rotation may be any appropriate amount, but for many applications it is preferred that the rotation be 90° from the opened to the closed position. To assist in the rotation, the cutting element may comprise a recess suitable for receiving a lever, e.g. a screwdriver, which allows an increase in torque applied to the cable. This recess can be mated with the locking bar on the second housing member to ensure that the cutting element is fully closed. It is preferred that the cutting wedge have an inner surface which is convex such that the wedge has an increasing thickness in a direction away from the piercing means. This means that when the piercing means penetrates the polymer, and the wedge is forced into the polymer by the rotation of the cutting element, an increasing force is applied. If, as is preferred, the cutting wedge has a triangular shape, in which the piercing means is one point of the triangle, an increasing width of the wedge is forced into the polymer during rotation, aiding in the separation of the polymer from the electrodes and ensuring that the electrodes stay apart from one another. The piercing means, and preferably the cutting wedge, are electrically insulating. The shape of the cutting wedge depends on the differential hardness of the electrodes and the polymer. It is necessary that the polymer be separated from the electrodes without shearing the electrodes. In a preferred embodiment, the piercing means has an angle of 30 to 60°, preferably 40 to 50°, e.g. 45°. The angle is determined as the complementary angle of the intersection of a center line of the recess and a tangent from the inside radius of the piercing means, as shown in FIG. 7 hereinafter. In addition, the cutting wedge may also comprise an arcuate rib disposed on the outer convex surface of the cutting wedge to maintain separation of the electrodes as the cutting element is rotated into the closed position. This rib may be positioned at any height on the cutting wedge outer surface, but it is preferred that it be at a height in line with the piercing means. The end portion of the polymer, which may comprise more than one material, e.g. a conductive polymer layer and an insulating polymer layer, is preferably retained in a cavity formed by the cutting wedge and a wall of the cutting module.

In a preferred embodiment, two grooves, preferably parallel grooves, are incorporated into the outer surface of the cutting wedge, positioned on either side of the piercing means and parallel to the top and bottom surfaces of the cutting element. The grooves are preferably parallel to assist in guiding the alignment of the electrodes. The grooves may be molded or cut, or otherwise formed, in the outer surface of the cutting wedge. The dimensions of the grooves are determined by the size of the electrodes and the spacing between the electrodes, but, in general, the width and depth of the grooves are larger, e.g. at least 5% larger, than the diameter of the electrodes. For example, grooves with a width of 1 mm (0.040 inch) and a depth of 1 mm (0.040 inch) are suitable for use with 22 AWG stranded electrodes having a diameter of about 0.8 mm (0.03 inch). The grooves are particularly useful when the elongate cable is to be installed at a low temperature, e.g. 0° C., at which the polymer is stiff. Under normal conditions, when the polymer is flexible, the piercing means makes contact with the cable and, as the cutting element is rotated, the cable is bent in the direction of rotation. The piercing means penetrates the polymer (both the insulating jacket, if present, and the polymer surrounding the electrodes) and displaces the polymer from the electrodes. As the rotation is completed, the first and second electrodes are forced into contact with the first and second electrode-contact sections, respectively. When the temperature is low, the stiffness of the polymer prevents it from bending during the initial part of the rotation, and the piercing means acts to cut the wire electrodes, rather than merely displace the polymer. The grooves adjacent to the piercing means provide space for the electrodes to be positioned, out of the cutting path of the piercing means. As the rotation continues, the polymer does eventually bend and the end portion of the polymer is removed.

It is important that electrical connection be made to the cable when it is installed into the plug. The plug comprises a first contact member which comprises a first prong suitable for insertion into one socket of an electrical power outlet and a second contact member which comprises a second prong suitable for insertion into a second socket of an electrical power outlet. Both the first and second contact members are positioned in the second housing member, generally protruding through the wall of the second housing member. A first electrode-contact section is positioned on the inner surface of the wall of the cutting module and can be electrically connected to the first contact member by means of a wire, solder or metal trace or other means. A second electrode-contact section is also positioned on the inner surface of the wall of the cutting module and can be electrically connected to the second contact member by means of a wire, solder or metal trace, or other means. The first and second electrode-contact sections are generally in the form of a brass, copper, or other metal terminal which can be attached to the appropriate position on the wall by means of screws, adhesive, tacks, or other means. The first and second electrode-contact sections are electrically isolated from one another and are physically separated, generally by a distance slightly less than the distance separating the first and second electrodes. When the cutting element is rotated in the cavity, and after the end portion of polymer is separated from the electrodes, the rotation forces the first electrode into physical contact with the first electrode-contact section and the second electrode into the second electrode-contact section. The presence of the cutting wedge maintains the separation of the electrodes, and the force of the cutting element against the wall of the cutting module maintains the first and second electrodes in contact with the appropriate electrode-contact section.

It is particularly preferred that the plug comprise additional electrical components for added functionality and safety. Thus in a preferred embodiment, a fuse is electrically connected to the first contact member and the second contact member. Suitable fuses for use with plugs designed for 120 volt applications include those which have a 7 ampere/125 volt rating, such as those sold under the name Picofuse™ 7A/125V by Littelfuse Inc. or those sold under the name Microtron™ fuse MCR-7 by Bussman Division of Cooper Industries. It is also preferred that the first electrode-contact section and the second electrode-contact section be electrically connected to a circuit interrupting device, which may be a ground fault circuit interrupter (GFCI) or a ground fault equipment protection circuit interrupter (GFEPCI). A GFCI with a rating of 5 mA can be used when personnel shock protection is desired, while an 8 mA-rated GFEPCI can be used to provide ground fault protection of equipment. Particularly preferred is the use of a GFEPCI with a non-replaceable fuse, such as that sold by Tower Switches Ltd. (catalog number 3033). In addition, a signal indicator, e.g. a light, may be electrically connected, e.g. to the fuse or to another component, for various purposes, e.g. to indicate if power is applied to plug or if the fuse has tripped.

The cable often comprises a metallic grounding braid, and in a preferred embodiment, the plug comprises a third contact member which comprises a third prong suitable for insertion into the ground socket of an electrical power outlet, and a ground-contact section into which a grounding element, e.g. the braid, can be placed. The ground-contact section may be positioned in the cutting module, outside of the cavity and adjacent the slot, and comprises a metallic clip or other attachment means which is electrically connected to the third contact member by means of a wire, solder or metal trace, or other means. In use, the metallic grounding braid is folded back from the end of the cable, and twisted to form a tail. The cable is then inserted into the plug to position it within the cavity. The tail is inserted into or otherwise attached to the clip, making physical and electrical connection.

For many embodiments of the plug, also present is a means for strain relief. When making a connection of the cable into the plug, it is important that the cable be held in position with sufficient strength so that it cannot readily be pulled out of the plug. Generally a "pullout force" of at least 25 pounds (11.4 kg), preferably at least 30 pounds (13.6 kg), particularly at least 35 pounds (15.9 kg) is required for routine use. The pullout force can be measured according to a test in which a known weight, e.g. 15.9 kg (35 pounds), is hung on the end of the cable (following insertion into the plug) at an angle of 180° for one minute. The weight is then removed and the cable measured to determine if any slippage from the plug, or cutting or tearing of the cable, has occurred. If no damage or slippage is observed, the pullout force is said to be at least as great as the known weight. The strain relief means allows adequate pullout force to be generated when the cable is installed in the plug. In a preferred embodiment the strain relief means comprises a first strain relief element in the form of a rib and a second strain relief element in the form of a tab. The first strain relief element is part of the first housing member, and is generally spaced in line with and behind the slot, so that an inserted cable, without the presence of the second housing member, will contact both an edge of the slot and the rib. The second strain relief element is part of the second housing member, preferably part of the second section of the second housing member, and is designed so that when the second housing member is mated with the first housing member, the second strain relief member is adjacent to the slot and at least partially covers the slot. This means that when the cable is inserted into the slot, and the second housing member is mated with the first housing member, the cable is forced into a serpentine configuration between the slot, the second strain relief element (e.g. the tab) and the first strain relief element (e.g. the rib). In a preferred configuration, the rib is generally U-shaped and forms a channel with the slot for insertion of the cable.

The tool of the second aspect of the invention comprises a cutting module and cutting element as described above. A housing comprising one or more members may be present.

In the third aspect of the invention, elements described above primarily in terms of a plug can be used to make an electrical connection between a first elongate electrical cable, e.g. a heating cable, and a second elongate electrical cable. The first and second cables may be the same or different depending on the type of connection to be made. The housing of the connector comprises an opening for receiving the second cable when the first and second housing members are mated. If three or more cables are to be connected, additional openings may be present. It is possible that the first housing member may comprise a second slot for receiving the second cable. Depending on the type of connection to be made, the second slot may be at the opposite end of the first housing member from the slot for the first cable (i.e. the first slot), or it may be located on a side perpendicular to that containing the first slot. Additional slots may be added as necessary.

The first electrode of the first cable is electrically connected to the third electrode of the second cable by means of a first connection means and the second electrode of the first cable is electrically connected to the fourth electrode of the second cable by means of a second connection means. Both first and second connection means are within the housing, generally within the first housing member, and may be any suitable type of element, e.g. a crimp, a terminal block, or an insulation displacement connector (IDC). Suitable connection means for connecting to a ground may also be present. While a single cutting module and cutting element may be present, it is possible that the connector may comprise two or more cutting modules and cutting elements, one for removing the insulation from each inserted cable.

Depending on the exact configuration of the connector, the type of cables, and the electrical connections in the connector, possible connections include a splice between two heating cables, a power connection between the heating cable and a power cable, a "tee" connecting the heating cable to two other heating cables, a cross in which four heating cables are connected, a powered splice in which the heating cable is connected to another heating cable and to a power cable, and a powered tee in which a power cable is connected to the heating cable as well as two other heating cables.

The housing members, the cutting module, the cutting element and other structural elements of the plug, tool, or connector may comprise an insulated metal or ceramic but preferably comprise a polymer which has an impact strength of at least 5 foot-pounds when shaped into the particular element and measured by such tests as UL 746C. Depending on the desired use conditions and the type of cable used, it may be desirable to use different materials for different parts of the plug or tool, e.g. polymeric housing members and cutting modules, but a ceramic cutting element. Preferred polymers are of light weight, can be shaped by injection- or transfer-molding or similar processing techniques, and will withstand required intermittent use and continuous use temperatures. Appropriate polymers include polycarbonate, nylon, polyester, polyphenylene sulfide, polyphenylene oxide, and other engineering plastics. Appropriate fillers and stabilizers may be present. To improve the impact strength of the plug or tool, internal elements such as ribs and bosses and external elements such as grooves may be incorporated into the design of the various elements.

While the cutting module and the cutting element have been described as having complementary arcuate surfaces, it is possible that a wedge-shaped cutting element, which could slide along a track, rather than rotate, could be used to strip polymer from an electrode and/or make an appropriate electrical connection.

The invention is described by the drawings in which FIG. 1 shows in perspective electrical plug 1 of the invention when fully assembled. Housing 3 is formed from first housing member 5, first section 7 of second housing member and second section 9 of second housing member which are secured by screws (not shown). Inserted into slot 23 is electrical cable 11. First contact member 13, second contact member 15, and third contact member 17, each in the form of a prong, are seen.

Figure 2:
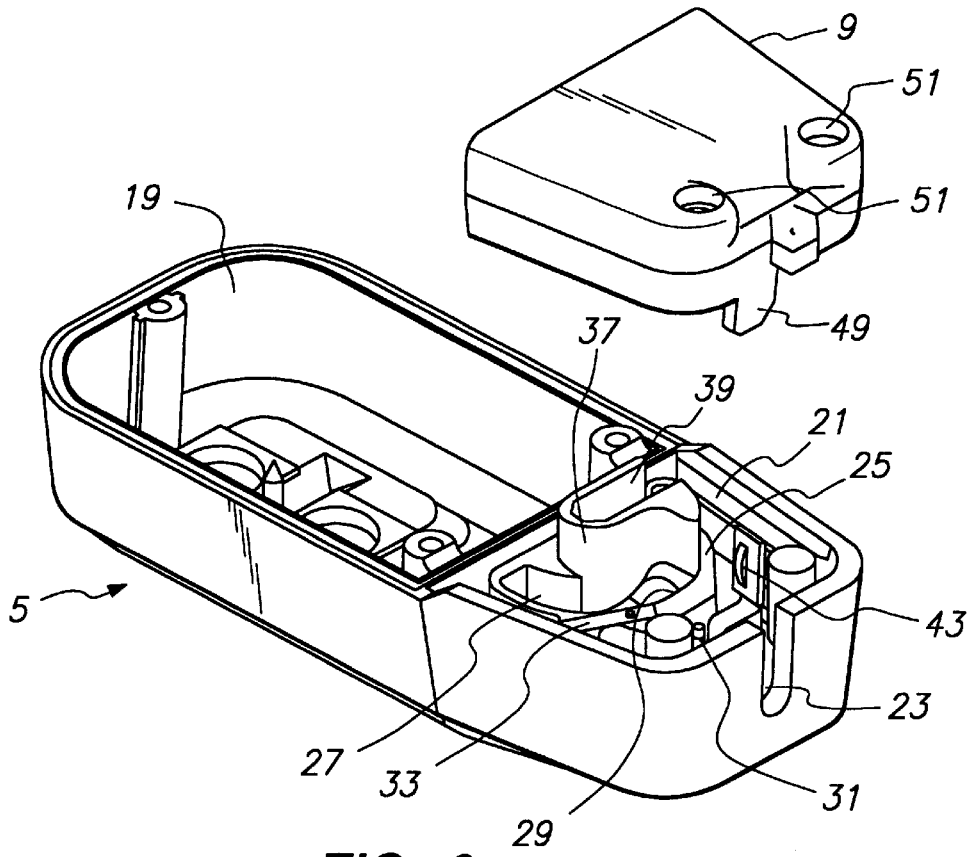
FIGS. 2 and 3 show in perspective schematic view the housing components of the electrical plug of the invention.
Figure 3:
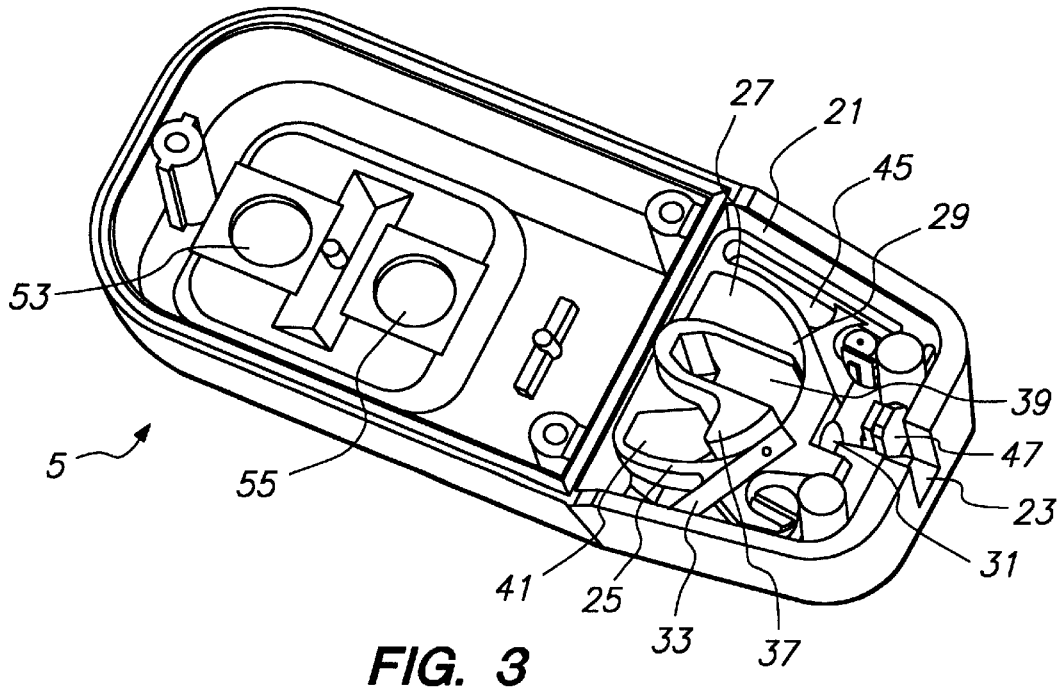

FIGS. 2 and 3 show first housing member 5 in perspective view. Also shown in exploded view in FIG. 2 is second section 9 of second housing member. First housing member 5 has two compartments 19,21. First compartment 19 is large enough for insertion of the necessary electronic components, e.g. a GFEPCI and a fuse, not shown. Openings in first compartment 19 allow insertion of various other elements: e.g. a signal light can be positioned in opening 53 and a reset button positioned in opening 55. Second compartment 21 contains slot 23 and cutting module 25. Contained within cutting module 25 are cavity 27 which has a concave arcuate inner surface on wall 29, and opening 31 which is aligned with slot 23. First electrode-contact section 33 is present on top of the wall 29, and folds over into cavity 27, as well. Cutting element 37 is shown in open position in FIG. 2, in which recess 39 is perpendicular to slot 23, and in closed position in FIG. 3, in which recess 39 is aligned with slot 23. When in the closed position, cutting element 37 forms pocket 41 for containment of the polymer which has been separated from the cable. Ground contact section 43 and pocket 45 for containing a ground lead are also present on cutting module 25. First strain relief element 47, in the shape of a rib, is positioned adjacent and spaced away from slot 23. Shown on second section 9 of second housing member in FIG. 2 is second strain relief element 49 in the form of a tab. Securing means 51, e.g. screws, allow second section 9 of second housing member to be attached to second compartment 21 of first housing member 5.

Figure 4:
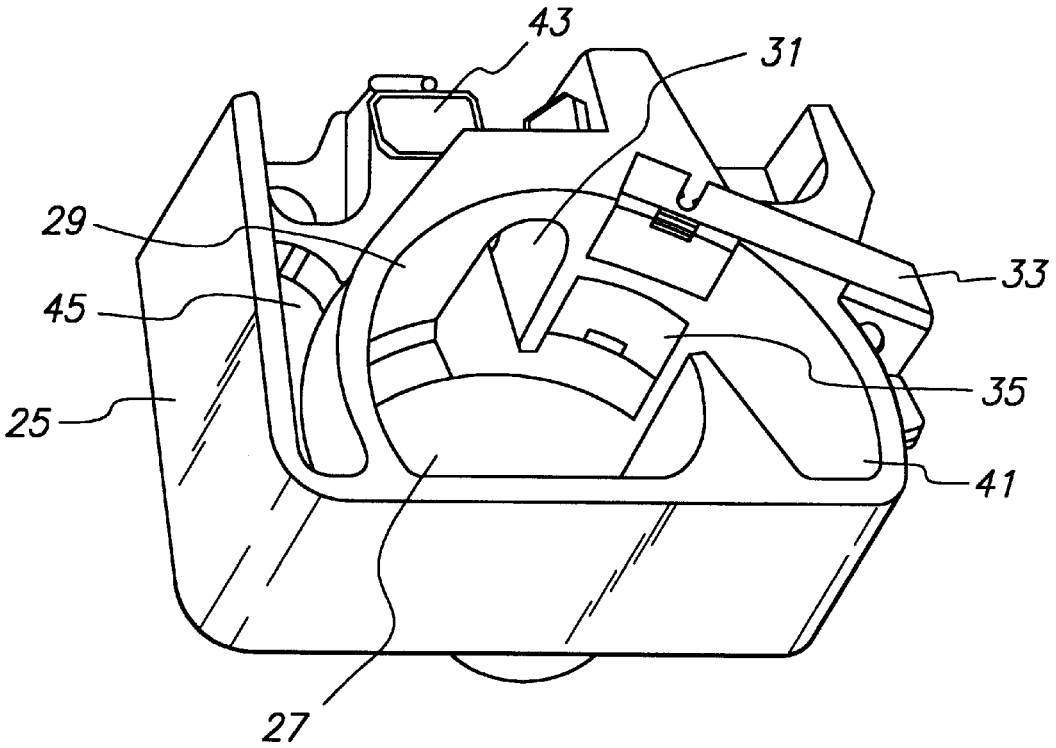
FIG. 4 shows in perspective schematic view a component of the cutting module component of the electrical plug of the invention.

FIG. 4 shows cutting module 25 without cutting element 37. Cavity 27, opening 31, and wall 29 with a concave arcuate surface are visible. Also shown are first electrode-contact region 33, second electrode-contact region 35, and ground contact section 43.

Figure 5:
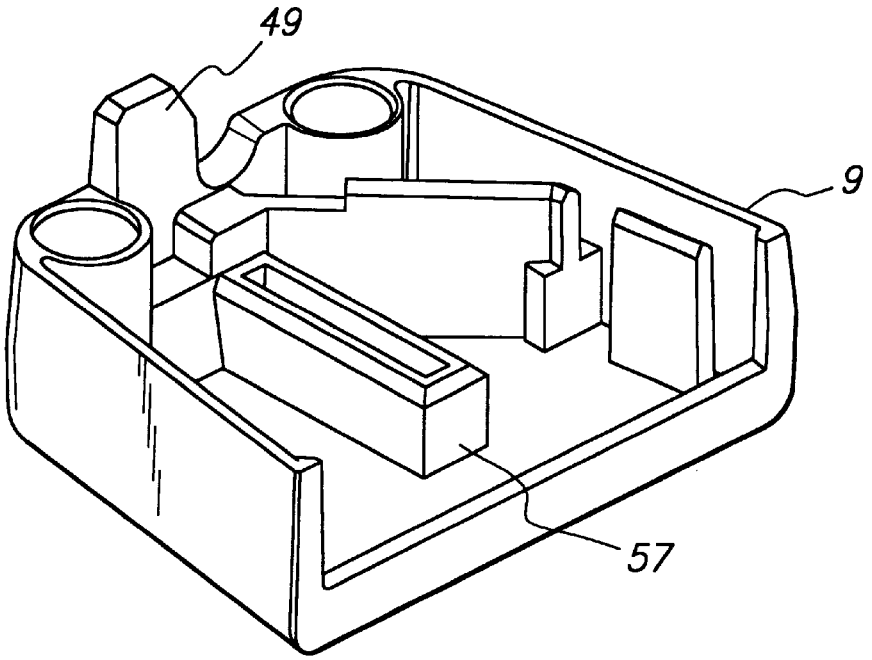
FIG. 5 shows in perspective schematic view a housing component of the electrical plug of the invention.

FIG. 5 shows the interior of second section 9 of second housing member. Visible are second strain relief element 49 and locking bar 57.

Figure 6:
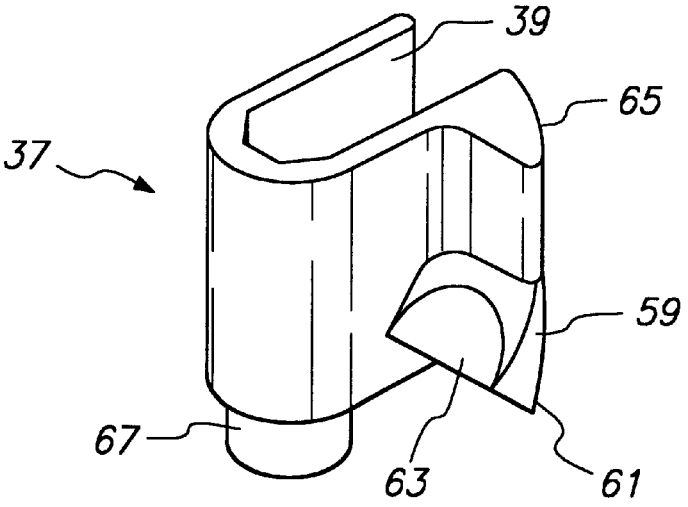
FIG. 6 shows in perspective schematic view a cutting element component of the electrical plug of the invention.

FIGS. 6 and 7 show cutting element 37, including recess 39. Cutting wedge 59, of generally triangular shape, has piercing means 61 at one point of the triangle, and has a convex inner surface 63. Convex outer surface 65 complements wall 29 with a concave arcuate surface. Mounting pin 67 can be inserted into cutting module 25, allowing cutting element 37 to rotate. Angle A, for this cutting wedge is about 45°, and is shown as the complementary angle of the intersection of a center line of recess 39 and a tangent from the inside radius of piercing means 61.

Figure 8:
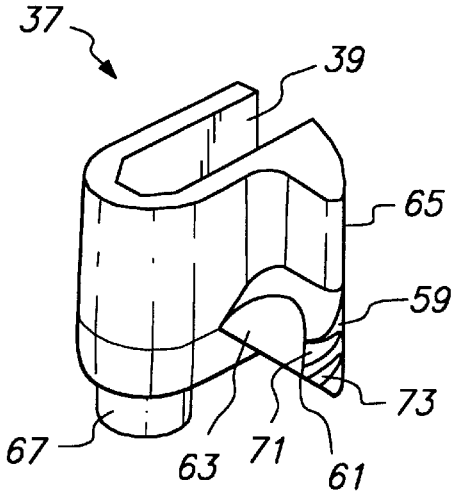
FIG. 8 shows in perspective schematic view another cutting element component of the electrical plug.
Figure 9:
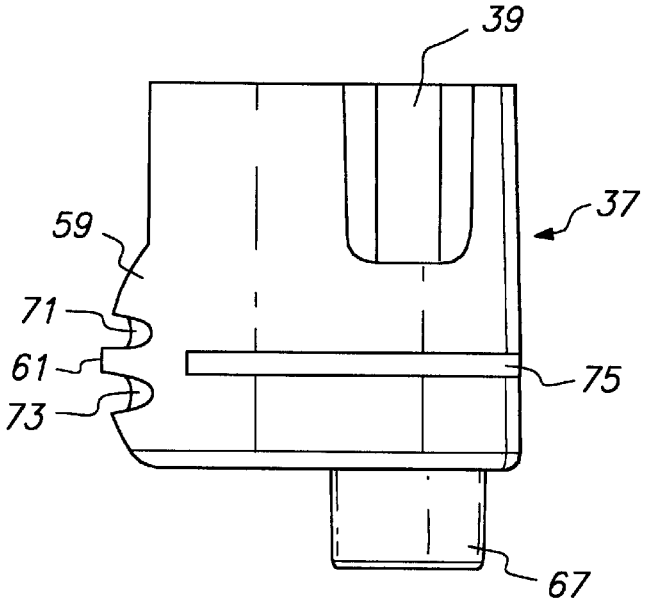
FIGS. 9 and 10 show in plan view two views of the cutting element of FIG. 8.
Figure 10:
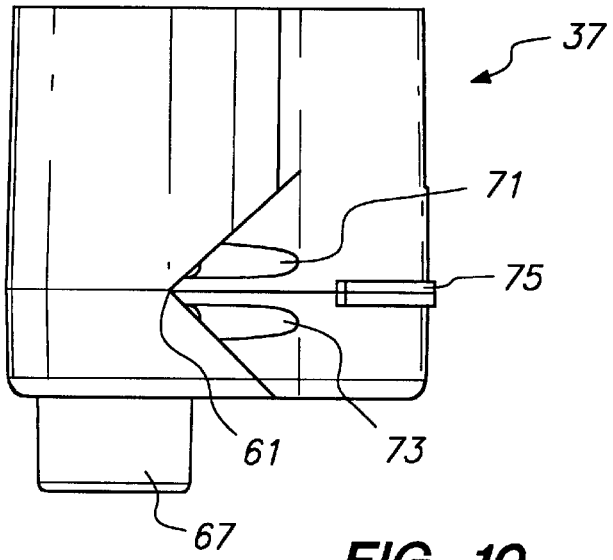

FIGS. 8 to 10 show cutting element 37 in different orientations. In contrast to the cutting element of FIGS. 6 and 7, cutting wedge 59 of cutting element 37 in FIGS. 8 to 10 comprises first groove 71 and second groove 73 positioned on opposite sides of piercing means 61. First and second grooves 71,73 are parallel to one another. Also shown in FIGS. 9 and 10 is arcuate rib 75 which is positioned at a height on convex outer surface 65 approximately the same as piercing means 61 and between the height of first and second grooves 71,73.

Although the invention has been described in detail for specific embodiments, it is to be understood that this is for clarity and convenience, and the disclosure herein includes all appropriate combinations of information found throughout the specification. It is to be understood that where a specific feature is disclosed in the context of a particular embodiment or figure, such feature can also be used, to the extend appropriate, in the context of another figure, in combination with another feature, or in the invention in general.

What is claimed is:

1. An electrical plug for connecting an electrical cable to an electrical power outlet, said electrical cable comprising a first elongate electrode and a second elongate electrode, said first and second electrodes surrounded by and separated from one another by a polymer, said plug comprising (A) a housing which comprises (1) a first housing member which comprises a slot for receiving the cable, and (2) a second housing member, the first and second housing members being movable relative to each other between a unique mated configuration and a demated configuration;

(B) a first contact member which comprises a first prong suitable for insertion into one socket of an electrical power outlet;

(C) a second contact member which comprises a second prong suitable for insertion into a second socket of an electrical power outlet;

(D) a cutting module which is positioned in the first housing member and which comprises (1) a cavity comprising a wall which has a concave arcuate inner surface, (2) an opening in the wall which opens into the cavity and is aligned with the slot for receiving the cable, (3) a first electrode-contact section which is positioned on the inner surface of the wall and can be electrically connected to the first prong, and (4) a second electrode-contact section which is positioned on the inner surface of the wall and can be electrically connected to the second prong; and (E) a cutting element which (1) fits within the cutting module, (2) comprises a cutting wedge which comprises (a) a convex arcuate outer surface which complements the inner surface of the wall, (b) piercing means suitable for penetrating the polymer, and (c) first and second grooves which are (i) parallel to one another, (ii) positioned on the convex outer surface, and (iii) positioned one on either side of the piercing means; and (3) rotates within the cavity from an opened position to a closed position so that, after the cable has been inserted into the cavity through the opening and the cutting element is rotated, the rotation (a) first, causes the piercing means to penetrate the polymer between the first and second electrodes, (b) second, causes an end portion of the polymer to separate from the electrodes, and (c) third, forces the first electrode into physical contact with the first electrode-contact section and the second electrode into physical contact with the second electrode-contact section.

2. A plug according to claim 1 wherein (1) the cutting element comprises a recess suitable for receiving a lever, and (2) the second housing member comprises a locking bar on an inner surface, which, when the cutting element is in the closed position, mates with the recess.

3. A plug according to claim 2 wherein the second housing member comprises first and second sections which are separated from one another.

4. A plug according to claim 3 wherein the second section comprises the locking bar.

5. A plug according to claim 3 which further comprises means for strain relief.

6. A plug according to claim 1 in which the first electrode-contact section and the second electrode-contact section are electrically connected to a circuit interrupting device.

7. A plug according to claim 6 wherein the circuit interrupting device is a ground fault circuit interrupter or a ground fault equipment protection circuit interrupter.

8. A plug according to claim 1 which further comprises a fuse electrically connected to the first contact member and the second contact member.

9. A plug according to claim 1 wherein the cutting module further comprises a ground-contact section into which a grounding element can be placed.

10. A plug according to claim 1 wherein the cable is an elongate heating cable which comprises (A) first and second elongate wire electrodes, (B) a plurality of resistive heating elements connected in parallel between said electrodes, and (C) an insulating jacket which surrounds the electrodes and heating elements.

11. A plug according to claim 10 wherein the cable further comprises a metallic grounding layer in the form of a braid or a tape.

12. A plug according to claim 1 wherein the piercing means comprises an electrically insulating material.

13. A connector for connecting an end of a first elongate electrical cable to an end of a second elongate electrical cable, said first cable comprising first and second elongate electrodes surrounded by and separated from one another by a first polymer, and said second cable comprising third and fourth elongate electrodes surrounded by and separated from one another by a second polymer, said connector comprising (A) a housing which comprises (1) a first housing member which comprises a first slot for receiving the first cable, and (2) a second housing member, the first and second housing members (a) being movable relative to each other between a unique mated configuration and a demated configuration, and (b) when mated comprising an opening for receiving the second cable;

(B) a first connection means for connecting the first electrode to the third electrode within the housing;

(C) a second connection means for connecting the second electrode to the fourth electrode within the housing;

(D) a cutting module which is positioned in the first housing member and which comprises (1) a cavity comprising a wall which has a concave arcuate inner surface, (2) an opening in the wall which opens into the cavity and is aligned with the first slot for receiving the first cable, (3) a first electrode-contact section which is positioned on the inner surface of the wall and can be electrically connected to the first connection means, and (4) a second electrode-contact section which is positioned on the inner surface of the wall and can be electrically connected to the second connection means; and (E) a cutting element which (1) fits within the cutting module, (2) comprises a cutting wedge which comprises (a) a convex arcuate outer surface which complements the inner surface of the wall, (b) piercing means suitable for penetrating the first polymer, and (c) first and second grooves which are (i) parallel to one another, (ii) positioned on the convex outer surface and (iii) positioned one on either side of the piercing means; and (3) rotates within the cavity from an opened position to a closed position so that, after the first cable has been inserted into the cavity through the opening and the cutting element is rotated, the rotation (a) first, causes the piercing means to penetrate the first polymer between the first and second electrodes, (b) second, causes an end portion of the first polymer to separate from the first and second electrodes, and (c) third, forces the first electrode into physical contact with the first electrode-contact section and the second electrode into physical contact with the second electrode-contact section.

14. A connector according to claim 13 wherein the first cable and the second cable are elongate heating cables.

* * * * *